US005472177A

United States Patent [19]

Benz et al.

[11] Patent Number: 5,472,177

[45] Date of Patent: Dec. 5, 1995

[54] MOLTEN METAL SPRAY FORMING APPARATUS

[75] Inventors: Mark G. Benz, Burnt Hills; Thomas F. Sawyer, Stillwater; William T. Carter, Jr., Ballston Lake; Paul L. Dupree, Scotia, all of N.Y.

[73] Assignee: General Electric Company, Schenectady, N.Y.

[21] Appl. No.: 168,294

[22] Filed: Dec. 17, 1993

[51] Int. Cl.[6] ..... B22F 9/08

[52] U.S. Cl. ..... 266/202; 222/603

[58] Field of Search ..... 266/202; 222/603; 164/46

[56] References Cited

U.S. PATENT DOCUMENTS

| | | | |
|---|---|---|---|
| 4,779,802 | 10/1988 | Coombs | 164/46 |
| 4,905,899 | 3/1990 | Coombs et al. | 164/46 |
| 5,160,532 | 11/1992 | Benz et al. | 266/202 |
| 5,176,874 | 1/1993 | Mourer et al. | 266/202 |
| 5,226,948 | 7/1993 | Orme et al. | 164/46 |
| 5,423,520 | 6/1995 | Anderson et al. | 266/202 |

*Primary Examiner*—George Wyszomierski
*Attorney, Agent, or Firm*—R. Thomas Payne; James Magee, Jr.

[57] ABSTRACT

A regulating gas flow valve is operatively connected to an oscillating molten metal spray forming ring converter through which a molten metal stream passes. The passing metal stream is impacted by gas jets from the converter which breaks up the metal stream into a spray pattern of small molten metal droplets. The valve regulates the flow of gas into the converter as a function of the converter oscillation which also operates the valve.

13 Claims, 4 Drawing Sheets

MOLTEN METAL SPRAY FORMING APPARATUS

BACKGROUND OF THE INVENTION

This invention relates to improved molten metal spray forming and, more particularly, to gas flow and temperature control in metal spray forming for more uniform microstructure in deposited metal from the metal spray.

One example of generating a molten metal spray in combination with a molten metal refining process is disclosed and described in U.S. Pat. No. 5,160,532—Benz et al assigned to the same assignee as the present invention. In the noted patent, a metal melting and refining apparatus provides a pool of molten refined metal. A small diameter molten metal stream from the pool is caused to flow through a molten metal atomization ring manifold in which a row of gas orifices generate plural converging gas streams from a gas in the manifold which impact the passing metal stream to convert the stream to a spray or plume of small molten metal droplets. The metal spray is directed to and deposited on a collector surface to generate a billet or other spray formed object.

When the noted process is employed to generate very large metal billets by sweeping or scanning the spray over the collector surface, it has been noted that some nonuniform microstructures appear in the final product due to large radial temperature distributions in the deposited metal. Metal billets of low thermal conductivity metal alloys such as nickel (ni) based super alloys including IN718 and Rene 95 appear to be particularly affected by this problem and it is an object of this invention to provide means to control temperature distribution in molten metal sprays to minimize non-uniform microstructures in spray deposited metal objects.

SUMMARY OF THE INVENTION

A spray forming atomization ring manifold for molten metal stream is caused to rotationally oscillate about a transverse axis to increase spray deposition range and effectiveness. Gas/metal relationship and temperatures in the molten metal spray are controlled by changing or varying the flow of atomizing gas into the manifold. Gas flow is controlled as a function of the oscillation or scanning of the ring manifold. This invention will be better understood when taken in connection with the following drawings and description.

BRIEF DESCRIPTION OF THE INVENTION

Figure 1:
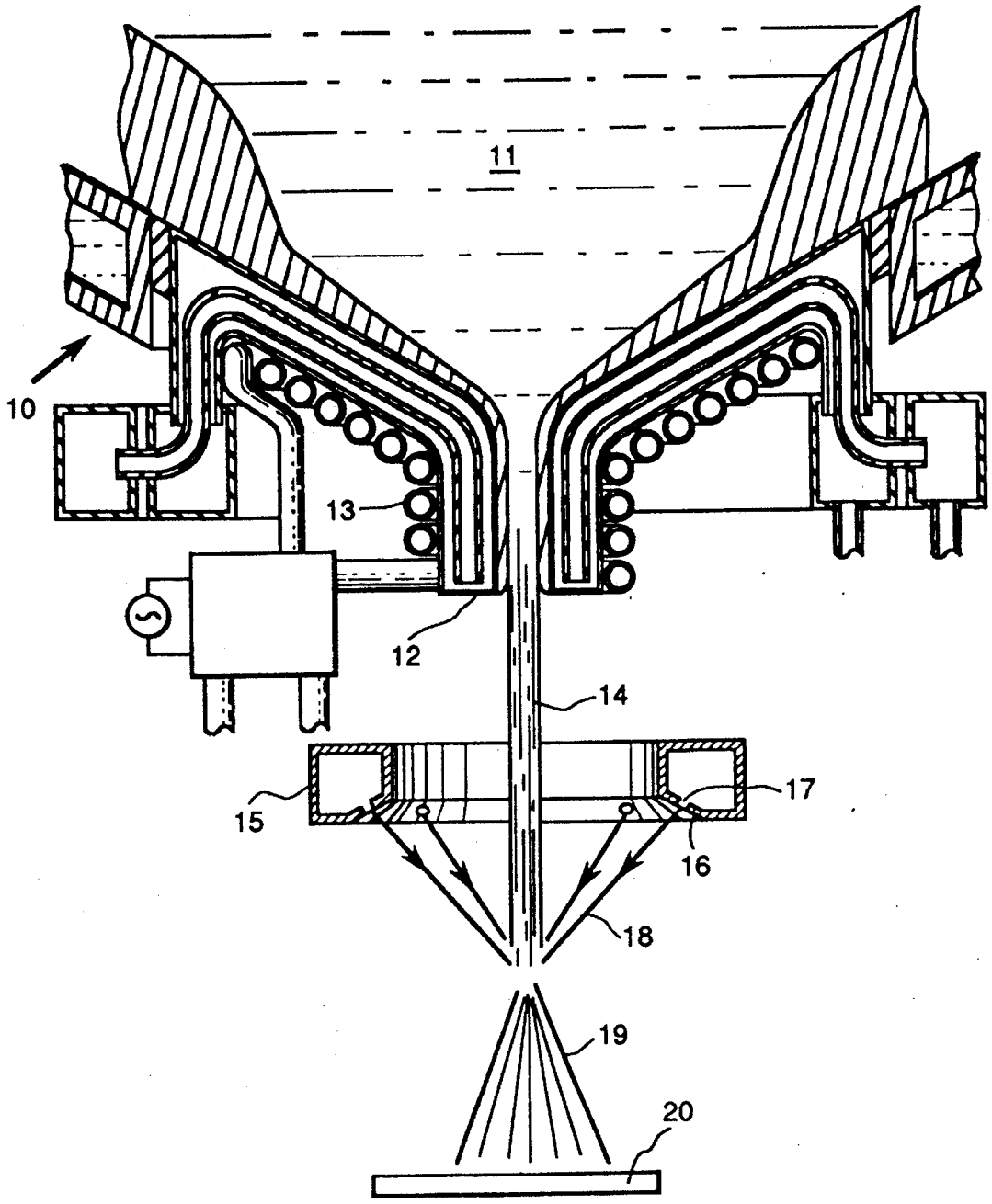
FIG. 1 is a partial and cross-sectional illustration of a metal melting and refining apparatus supplying stream of molten metal through a spray forming atomization ring manifold.

Referring now to FIG. 1, a metal melting furnace 10 includes a pool 11 of molten metal such as a super alloy metal as described. An exit nozzle tube or orifice 12 is connected to pool 11. An electrical induction heating coil 13 is connected to a suitable source of electrical power and surrounds orifice 12 and pool 11 to assure desired molten metal 11 liquidity. From nozzle tube 12 a small diameter molten metal stream 14 passes from molten metal pool 11 through a molten metal spray forming atomization manifold 15. Spray forming manifold 15 comprises a hollow ring manifold positioned to surround the passing molten metal stream 14. In one form, ring manifold 15 also includes a peripheral conical or tapered surface 16 in which a row of gas jet devices or orifices 17 are directed in converging relationship to the metal stream 14 after passing through ring manifold 15. Ring manifold 15 is connected to a suitable elevated pressure source (not shown) of an inert gas such as argon or nitrogen. This inert gas is caused to issue from jet devices or orifices 17 in ring manifold 15 as a peripheral row of gas streams 18 which converge upon and impact the molten metal stream 14 for its conversion into a spray or plume 19 of small molten metal droplets. Spray 19 is directed against a collector surface 20 or other preform object to provide a metal billet or other metal structure.

Best results are obtained when the molten metal spray 19 from the ring manifold 15 is directed angularly against a collector or preform object rather than perpendicularly. Angular impingement provides improved deposition efficiency as well as improved preform metal density and microstructure. Some collector preforms are of a size and shape which require the spray pattern to be directed with different or changing angles of impingement rather than with a constant or fixed angle. For example, it may be desirable to have the molten metal spray pattern 19 sweep or scan across the collector surface. One example of a sweeping or scanning system and apparatus is disclosed and claimed in a prior application Ser. No. 07/753,497 Johnson et al, filed Sep. 3, 1991, and assigned to the same assignee as the present invention, the application of which is now abandoned. Such a scanning system requires the converter to be angularly adjustable, e.g. to oscillate about a transverse axis of its defined central aperture. A graphic illustration of a cycle of scanning angular adjustment of converter 16 is illustrated in combined FIGS. 2A, 2B, and 2C.

Figure 2C:
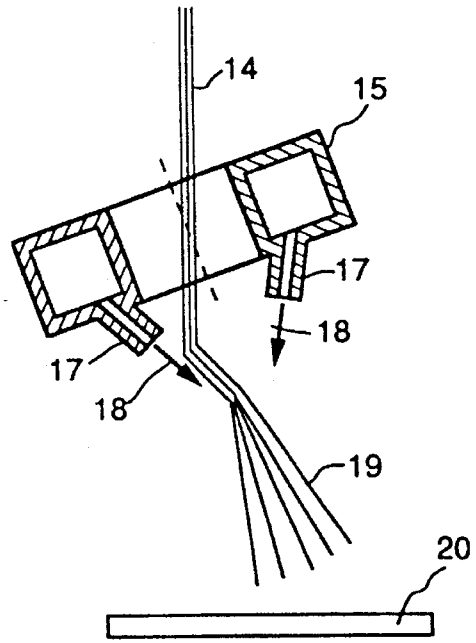
FIGS. 2A, 2B and 2C are schematic illustrations of transverse angular rotation of the ring converter of FIG. 1 at different positions in its oscillation cycle.
Figure 2B:
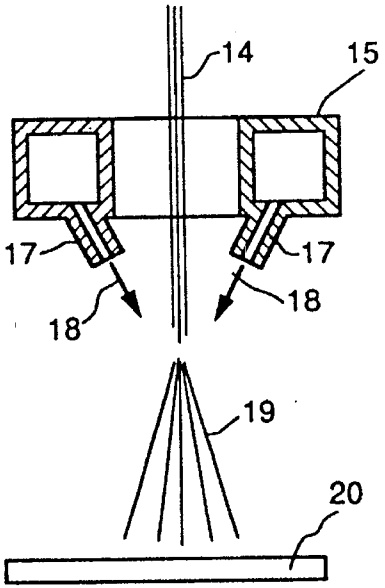
Figure 2A:
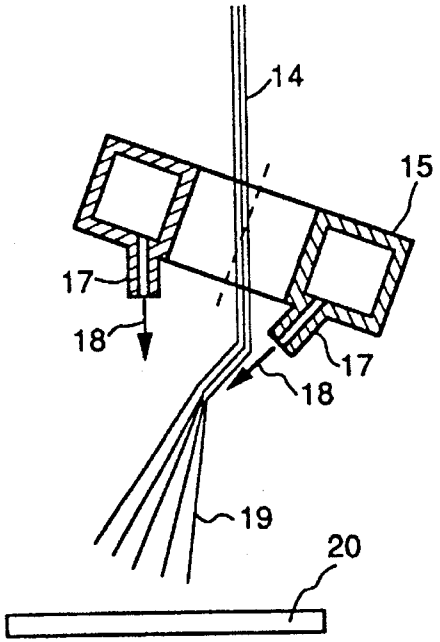

Referring now to FIG. 2A, ring manifold 15 is shown in an angularly adjusted position in one direction as compared to the non-angularly adjusted ring manifold 15 in FIG. 2B. Molten metal stream 14 passes through ring manifold 15 and is impacted by gas streams 18 issuing from a row of gas jets 17 (only two shown). The result is a conversion of the molten metal stream 14 into a plume or spray 19 of small molten metal droplets which are deposited on a collector 20. Because of the angular adjustment and a corresponding change in the impacting relationship of gas streams 18, spray pattern 19 is substantially deflected from its FIG. 2B neutral or non-adjusted position. Accordingly, where ring manifold 15 is rotated to an angular position in the opposite direction as illustrated in FIG. 2C, spray pattern 19 is correspondingly deflected in the opposite direction. This kind of deflection between FIGS. 2A and 2C is ordinarily carried out in a constant repetitive motion from one deflection position to its opposite deflection position so that the molten metal spray pattern sweeps or scans across the collector for improved metal deposition. One means for providing and controlling the sweep or scan of a spray forming converter is disclosed and described in the noted prior Johnson application in which a computer operated drive system is utilized so that the time of each sweep or oscillation of the converter may be varied and certain delays may be programmed into the sweep to cause changes in the deposited metal. It is in this sweeping or scanning process that the noted undesirable characteristic of non-uniform microstructures has been identified at the extreme range of the scan and extreme radial dimension of the molten metal pattern. However, by means of a gas/metal ratio control means of the present invention the gas/metal relationship generating the spray patterns 19 (FIGS. 2A, 2B, 2C) may be effectively varied to change or avoid large radial temperature distribution in the deposited metal.

Figure 3:
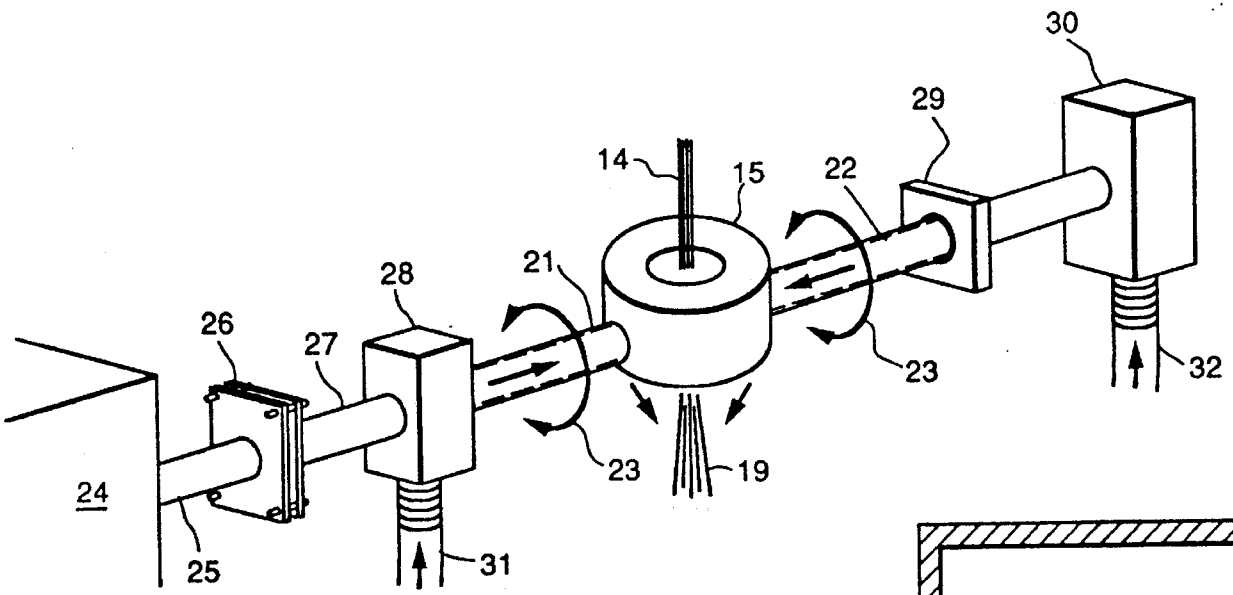
FIG. 3 is a schematic illustration of the ring manifold of FIG. 1 mounted for the transverse angular rotation of FIGS. 2A. 2B and 2C, together with its gas flow delivery system.

A combination of a ring manifold converter 15 mounted for oscillation scanning together with its gas delivery system is illustrated in FIG. 3.

Referring now to FIG. 3, ring manifold 15 is supported between and connected in fluid flow relationship to opposite gas conduits or hollow shafts 21 and 22 for oscillatory motion as indicated by their encircling arrows 23. A drive motor means 24 rotates drive shaft 25 on one side of a flexible coupling 26 and shaft 27 on the opposite side. Shaft 27 projects into a gas supply means such as a chamber or manifold 28 to rotate hollow shaft 21 and ring manifold 15. Gas from manifold 28 passes through hollow shaft 21 into ring manifold 15. Correspondingly, opposite hollow shaft 22 is connected to ring manifold 15 and passes through a shaft support bearing 29 to a further gas supply chamber 30 from which a gas flows through shaft 22 into ring manifold 15. Gas from a primary source (not shown) is delivered to supply manifolds or chambers 28 and 30 from a suitable source (not shown) through gas conduits 31 and 32, respectively. Drive motor means 24 oscillates ring manifold 15 to cause predetermined deflection of spray 19 as illustrated in FIGS. 2A and 2C. Gas flow into ring manifold 15 enters from the diametrically opposite hollow shafts 21 and 22 in a predetermined volume flow to generate a spray pattern 19 of a predetermined gas/metal ratio. With the gas flow means of the present invention the noted gas/metal ratio may be controllably varied in correlation with manifold oscillation to improve metallic characteristics in the deposited metal on collector 20. One such gas flow control means is illustrated in FIG. 4.

Figure 4:
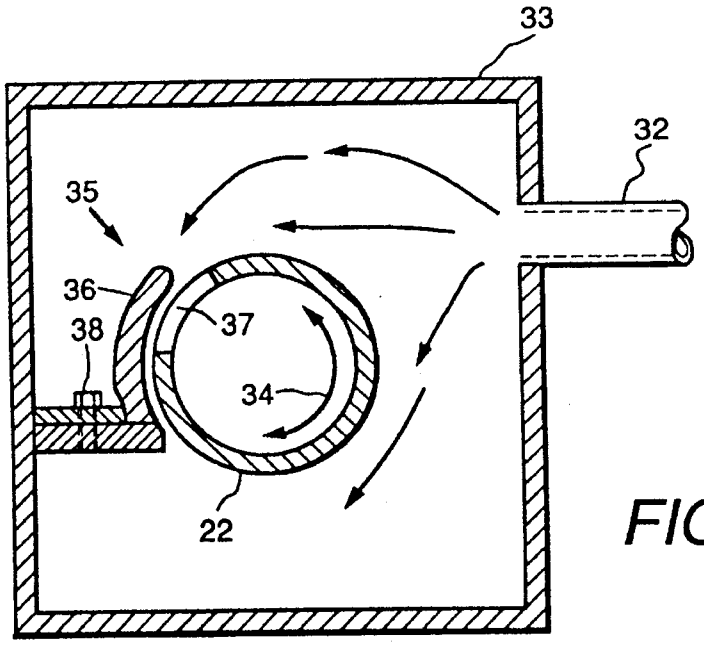
FIG. 4 is a schematic and cross-sectional illustration of a gas flow control means operating as a function of manifold oscillation.

Referring now to FIG. 4, a gas supply chamber 33 represents a chamber 28 or 30 of FIG. 3, chamber 30 for example. Gas chamber 33 is illustrated with its respective hollow conduit shaft 22 leading to ring manifold 15. Shaft 22 rotationally oscillates within gas chamber 33 as shown by arrow 34 and is driven by driver 24 (FIG. 3). Gas flow from chamber 33 into hollow shaft 22 is controlled or regulated by a kind of gas flow slide valve assembly 35. Gas flow slide valve 35 comprises a closure or iris member 36 mounted closely adjacent shaft 22 and correspondingly curved therewith. Shaft 22 includes a predetermined sidewall inlet aperture 37 therein adjacent iris member 36 so that iris member 36 will overlie aperture 37 to a greater or lesser degree as an integral function of the rotational position of shaft 22 and its oscillation. As ring manifold 15 and its shaft 22 oscillate, as illustrated and described with respect to FIGS. 2A and 2C, shaft 22 inlet aperture 37 is progressively closed off by iris 36, or progressively more exposed by iris 36, to the gas in supply chamber 33. By this means, gas flow into ring manifold 15 may be changed to correspondingly change the gas/metal ratio of metal spray 19, FIG. 3. Numerous gas flow adjustments are available with the gas flow slide valve assembly 35 as illustrated in FIG. 4. For example, inlet aperture 37 may be of a configuration which, in combination with an iris of a predetermined and cooperative configuration, will admit a programmed delivery of gas, for example, less gas at an early stage in an oscillating cycle to a maximum at the end of the cycle. Alternatively, iris member 36 may be replaced with other such members of different configurations correlated with other apertures 37 of different configurations. One or more set or mounting screws 38 with an elongated screw aperture permit replacement of iris member 36 as well as its clearance adjustment to shaft 22. Because the gas flow control means of this invention is integrated with and activated by oscillation of the converter, it is particularly advantageous when utilized with a computer controlled oscillation system, for example, the system of the noted prior Johnson et al application. The Johnson system is directed primarily to precision control of manifold oscillation. The present invention is primarily directed to gas flow control during manifold oscillation. However, gas flow control is integrally connected with converter oscillation which activates and regulates gas flow in unison with manifold oscillation. Accordingly, the Johnson system represents one advantageous tool or operating means for the gas flow control means of this invention, the combination being illustrated and described with respect to FIG. 5.

Figure 5:
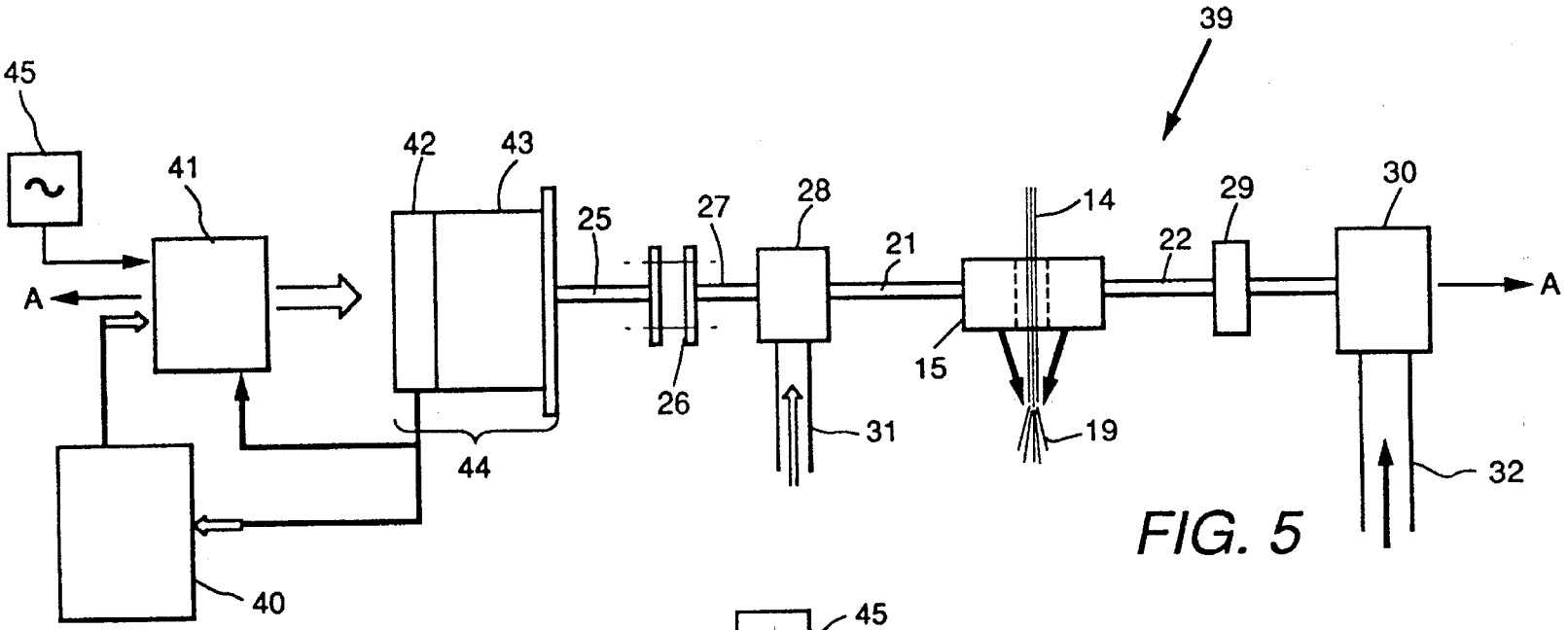
FIG. 5 is a schematic illustration of a computer controlled oscillation system operable with the variable gas flow control means of this invention.

Referring now to FIG. 5, computer control system 39 comprises a programmable computer 40 operatively connected to a driver 41. Driver 41 is connected to an encoder 42 which is integral with a D.C. (direct current) motor 43 and the combination of encoder 42 and motor 43 operates as a servomotor 44 to rotate drive shaft 25 through flexible coupling 26 and manifold 28 to drive hollow shaft 21 for oscillation of ring manifold 15. Either one or both gas chambers 28 and 30 of FIG. 5 may include the gas control means of FIG. 4, and gas delivery to ring manifold 15 is regulated through computer 40 control of the oscillation cycle of ring manifold 15 since a change in the oscillation characteristics such as frequency, cycle rate, operational angle, etc., will change the gas flow through the slide valve 35 of FIG. 4 and result in a change of the gas/metal ratio and temperatures in spray pattern 19.

Oscillation is an important control feature for manifold gas flow control in this invention, and precise control over oscillation will provide the dual feature of an optimum spray pattern and gas flow control for stabilizing temperatures in the spray pattern.

Figure 6:
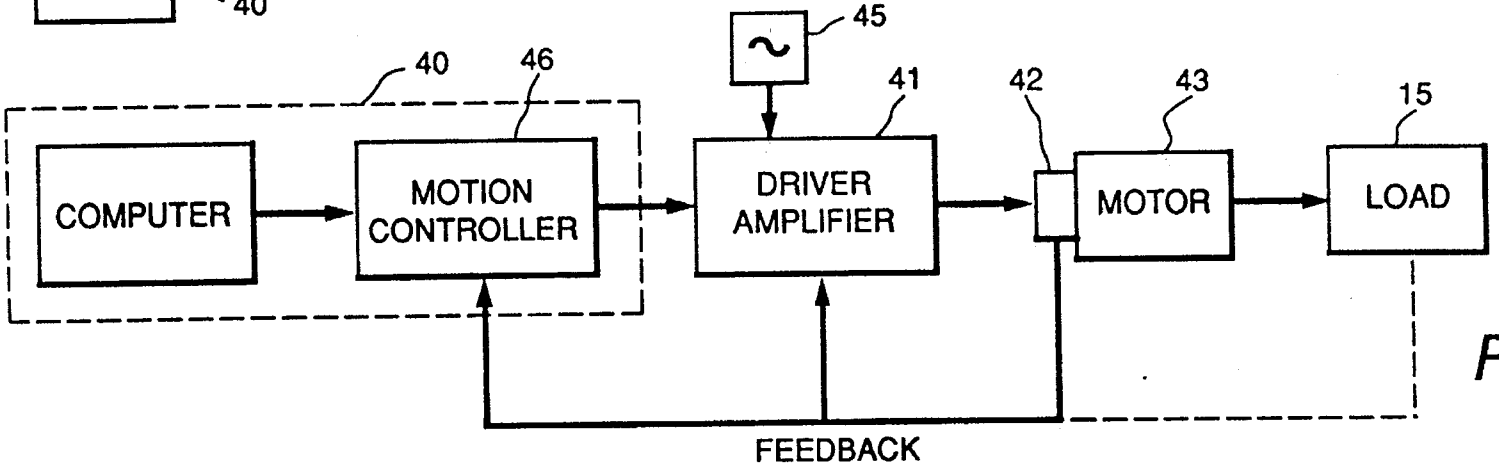
FIG. 6 is a further block diagram of the computer system of FIG. 5 illustrating a feedback arrangement for the manifold oscillation cycle.

For oscillation control of ring manifold 15 14, the above described servomotor 44 is interfaced with programmable computer 40 to enable encoder 42 to send a signal to host computer 40. Servomotor 44 rotates its drive shaft 25 and hollow shaft 21 which is fixed to ring manifold 15 and rotates ring manifold 15 according to a predetermined motion profile or oscillation pattern. Electrical power input to system 39 is obtained from a suitable power source 45 to driver 41. Encoder 42 determines the angular position of drive shaft 25 and generates a signal representative of the position of the drive shaft 25 which is transmitted to computer 40. Computer 40 includes the hardware and software necessary to read the signal from the encoder and calculate the position of drive shaft 25. Computer 40 then compares the position of drive shaft 25 with the programmed or calculated motion profile to determine if there is an error in the position of drive shaft 25. If there is an error in motor 43 output, computer 40 calculates a correction and provides a corrective signal to driver 41 which controls motor 43 to obtain a corrected output. As illustrated in FIG. 6, encoder 42 and computer 40 act as a feedback system which provides the servo feature to driver 41 and motor 43.

Referring to FIG. 6, encoder 42 sends a feedback signal to driver 41 and motion controller 46 of computer 40 so that errors in motor position can be corrected. The precision and control provided by the described computer system are favorable to incorporation of the variable gas delivery means of this invention which can be adjusted or adapted to provide a desired gas/metal ratio in spray pattern 19 over a wide range of system operation.

With the system as described, a particular motion profile may be implemented by computer 40 based upon the input of certain motion profile parameters. Since the control system is electronic and involves the use of a D.C. motor 43 with an electronic servo system, the output of motor 43 may be monitored and self-adjusted so that the desired motion profile may be precisely and accurately achieved. The use of an electrical servomotor 44 to control the motion profile of ring manifold 15 permits continuous gas atomization and spray forming without need to shut down the operation in order to change a parameter of the motion profile. For example, computer 40 may be programmed to change speed, position, dwell time, frequency scan or sweep angle, etc., without deactivating ring manifold 15 and interrupting gas delivery. The result is that extremely complex motion profiles may be achieved to obtain a wide variety of complex deposition patterns. For example, the control system may be programmed so that, during an initial time period, the oscillation of the manifold occurs between a first oscillation angle at a particular frequency with a certain dwell time. After this first period of time the dwell time can be increased or decreased as may the oscillation angle and frequency and speed of oscillation.

When the gas delivery means of this invention is incorporated into programmable computer control system 39, the gas volume entering the converter may be changed in conformance with the oscillating pattern. For example, the computer system may increase or decrease the range of manifold oscillation, and in so doing, change the operating relationship of closure 36 and aperture 37 of FIG. 4 with a resulting difference in the quantity of gas passing therethrough. More particularly, since system 39 may provide an increase or decrease in the dwell time at the ends of the oscillation cycle, an increase or decrease may permit aperture 37 of FIG. 4 to remain open during the dwell and pass more gas into the ring manifold. A higher frequency oscillation may provide less gas than a lower frequency oscillation. A wide range of gas flow conditions and resultant temperature control are available with the computer control system as described, together with the gas flow control means of this invention. The FIG. 4 iris 36/aperture 37 configurations, together with optimum oscillation relationships, provide a change in the gas/metal ratio in spray pattern 19 to reduce microstructures in the deposited metal by changing the enthalpy of the molten metal droplets in the spray pattern.

Collector 20 may be a fixed or moving surface such as a rotating mandrel or an object on a traveling belt or conveyor, or an object retained by an adjustable jig. The computer system as described may be further integrated with a moveable collector 20 FIGS. 1 and 2 or an adjustable jig in concert with the spray forming to more effectively control molten metal deposition. Control system 39 as described is advantageously utilized to provide a variable gas/metal ratio in the metal spray pattern from ring manifold 15.

While this invention has been disclosed and described with respect to a preferred embodiment, it will be understood by those skilled in the art that various changes and modifications may be made without departing from the spirit and scope of the invention.

What is claimed is:

1. A molten metal spray forming system comprising:

a manifold having an aperture therethrough for the passage of a molten metal stream, the manifold including a plurality of gas jet means therein for providing converging gas streams that impact the metal stream after the metal stream passes through the aperture and converts the molten metal stream into a spray pattern of small molten metal droplets for deposition on a collector surface;

mounting means for mounting the manifold for oscillation about a transverse axis of the aperture;

gas supply means, operatively connected to the manifold, for supplying a gas thereto; and gas flow control means including a closure member operatively overlaying a gas inlet, the gas flow control means being operatively connected to the manifold and activated by oscillation of the manifold for varying the flow rate of the gas into the manifold.

2. The system of claim 1 wherein a programmable computer controlled electric motor drive is operatively connected to the mounting means for oscillating the manifold.

3. The system of claim 1 wherein the mounting means further comprises:

gas conduits for providing gas flow into the manifold.

4. The system of claim 1 wherein the mounting means further comprises:

a pair of opposed gas conduits which mount the manifold therebetween for oscillation therewith and gas flow therein.

5. The system of claim 4 wherein the gas flow control means further comprises:

a gas inlet aperture in one of the opposed pair of gas conduits; and a gas chamber enclosing the inlet aperture, the closure member overlying the inlet aperture so that oscillation of the gas conduit having the inlet aperture therein causes the inlet aperture to be progressively closed off or progressively exposed to gas flow therethrough from the gas chamber.

6. A molten metal spray forming system comprising:

a manifold having an aperture therethrough for the passage of a molten metal stream, the manifold including a plurality of convergent gas jet means surrounding the aperture and molten metal stream;

a pair of opposed gas conduit means connecting the manifold therebetween for oscillating the manifold and for providing gas flow thereto;

gas supply means, operatively connected to the gas conduits for supplying a gas thereto, the gas flow into the manifold issuing from the gas jet means in convergent relationship to impact the passing molten metal stream such that the metal stream is converted into a spray pattern of small molten metal droplets for deposition on a collector surface;

programmable computer controlled electric motor drive means, operatively connected to the gas conduit means, for oscillating the manifold; and gas flow control means including a closure member operatively overlaying a gas inlet, the gas flow control means being operatively connected to the gas conduit means, for varying the flow of gas through the gas conduit into the manifold thereby changing the ratio of gas to metal in the spray pattern.

7. The system of claim 6 wherein one of the gas flow control means is operatively connected to each of the gas conduits.

8. The system of claim 6 wherein the electric motor drive means further comprises:

a servomotor combination including an encoder and a D.C. motor.

9. The system of claim 8 wherein a motion controller and driver amplifier are interconnected between the servomotor and the computer.

10. The system of claim 9 wherein a feedback circuit is established from the servomotor and the driver amplifier to the motion controller.

11. A molten metal spray forming atomizer comprising:

a manifold defining an aperture having a center through the manifold adapted to pass a molten metal stream through the aperture, the manifold having gas jets positioned therein surrounding the aperture, the manifold being adapted to receive a gas therein under pressure and to direct the gas through the gas jets to engage the molten metal stream after the molten metal stream has passed through the aperture so that the metal stream is atomized into a spray pattern having a gas/metal ratio;

mounting means for angular adjustment rotation of the atomizer about a transverse axis of the aperture; and a gas control means comprising:

a gas inlet operatively positioned in the mounting means;

a gas chamber enclosing the inlet in the mounting means; and a gas flow slide valve assembly including a closure member operatively overlaying the gas inlet so that oscillation of the mounting means causes the gas inlet to be progressively closed off or progressively exposed to gas flow from the gas chamber thereby changing the gas/metal ratio of the spray pattern.

12. The system of claim 11, wherein the mounting means comprises:

at least one hollow shaft operatively connected to the manifold.

13. The system of claim 12, wherein the at least one hollow shaft supplies the gas to the manifold.

* * * * *